United States Patent [19]

Trotter

[11] 3,977,714

[45] Aug. 31, 1976

[54] STOP ASSEMBLY

[76] Inventor: Floyd Arthur Trotter, 205-678 W. 45 Ave., Vancouver, British Columbia, Canada

[22] Filed: Mar. 3, 1975

[21] Appl. No.: 554,499

[52] U.S. Cl. ..... 292/343; 16/86 R
[51] Int. Cl.[2] ..... E05C 17/54
[58] Field of Search ..... 292/DIG. 15, 342, 343; 16/82, 86 R, 86 A; 254/104

[56] References Cited

UNITED STATES PATENTS

| | | | |
|---|---|---|---|
| 1,119,650 | 12/1914 | Smith | 292/343 |
| 1,129,010 | 2/1915 | Pfau | 16/86 A |
| 1,154,148 | 9/1915 | West | 292/343 |
| 2,205,614 | 6/1940 | Bashe | 292/342 |
| 2,425,937 | 8/1947 | Hilton | 16/82 UX |
| 3,833,963 | 9/1974 | Waters | 292/DIG. 15 |

*Primary Examiner*—Andrew V. Kundrat
*Attorney, Agent, or Firm*—Carver and Company

[57] ABSTRACT

A door stop assembly having a wedge-shaped stop member formed of a resilient material and having a pair of cylindrical projections extending in spaced longitudinal alignment from the undersurface thereof and a stop plate having two pairs of spaced longitudinally disposed openings adapted to receive projections of the stop member. The plate is positioned adjacent the door so that the stop member can be disposed in a jamming position to hold the door closed and a stop position in which the door can be opened slightly.

3 Claims, 3 Drawing Figures

STOP ASSEMBLY

BACKGROUND OF THE INVENTION

1. Field of the Invention

This invention relates to door securing devices and in particular to door stops which can be inserted between the door and the floor to prevent opening of the door.

2. Prior Art

The use of door stops for securing doors against unauthorized entrance is well known. The use of a stop which maintains the door in the closed position also enhances the efficacy of chain-type securing devices which are usually secured between the door and the door jamb.

As is well known chain securing devices, even though used in conjunction with ordinary door locks, are not proof against unauthorized entry as once the door has been unlocked chain securing devices usually allow the door to open somewhat, which enables those versed in the art of breaking and entering to release the chain.

In order to increase security, many types of door stops have been devised which effectively maintain the door in its closed position even though the door may be unlocked. Most of these door stop devices embody a wedge which fits between the door and the floor and which can be locked in place to the floor. In most of such devices however, it is possible to rotate the wedge-shaped stop from beneath the door without dislodging it from the floor and thus open the door slightly to enable other tools to be used to remove the door stop.

SUMMARY OF THE INVENTION

The present invention provides a door stop assembly in which the door stop can be disposed selectively in one of two positions to either hold the door firmly closed or to allow the door to be opened slightly.

The door stop assembly of the present invention does not require keys or locks and furthermore when not in use, leaves the floor behind the door in a relatively clear unencumbered condition.

The door stop assembly of the present invention includes a wedge-shaped stop member, formed of a resilient material, extending partially between the door and the floor over which the door swings and having a pair of longitudinally disposed spaced projections extending from the undersurface thereof and a floor plate adapted to be secured to the floor behind the door having two pairs of longitudinally spaced openings for selectively receiving the projections of the stop member, said plate being adapted to be located relative to the door so that the stop member can be disposed in a jamming position to hold the door closed and a stop position in which the door can be slightly opened.

A detailed description following, related to the drawings, gives exemplification of apparatus according to the invention which, however, is capable of expression in means other than those particularly described and illustrated.

DETAILED DESCRIPTION

Figure 1:
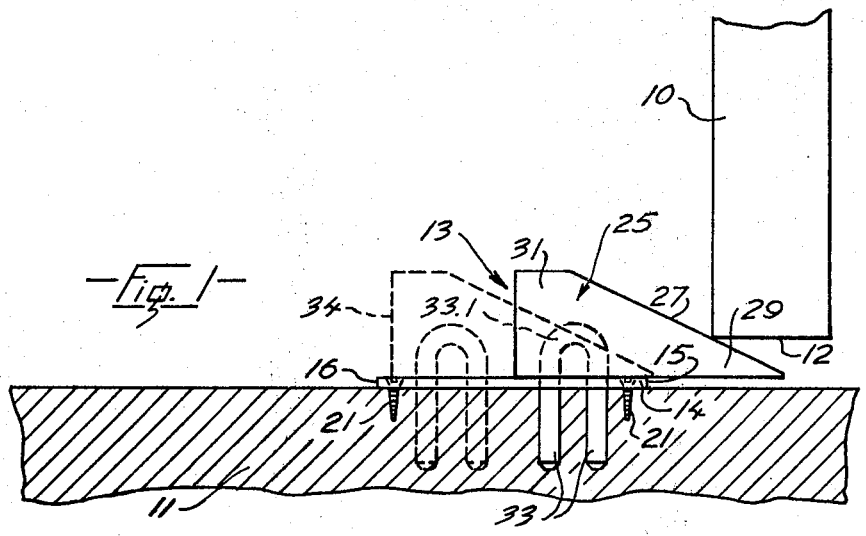
FIG. 1 is a central side of the door stop assembly shown in an operative position between the door and the floor.
Figure 2:
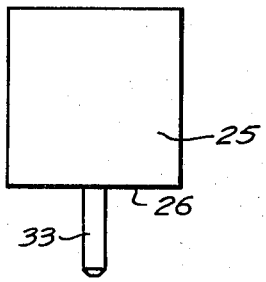
FIG. 2 is an end view of the stop member.
Figure 3:
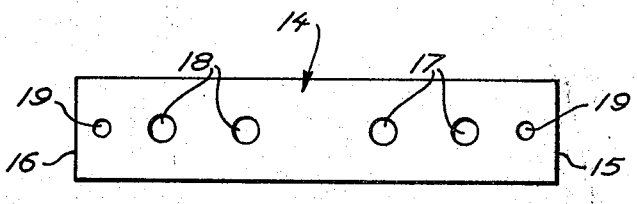
FIG. 3 is a plan view of the door plate.

Referring to the drawings, the numeral 10 indicates generally a door shown only partially, swingable above a floor 11. The lower edge 12 of the door is spaced slightly above the floor to provide adequate clearance of the door to swing freely.

The stop assembly, generally 13, of the invention includes a thin rectangularly shaped floor plate 14 having a front end 15 and a rear end 16. The plate is provided with a pair of spaced longitudinally aligned openings, severally 17, adjacent the front end of the plate and a similar pair of longitudinally aligned spaced openings, severally 18, at the rear end of the plate. The plate has also a pair of holes, severally 19, through which screws 21 can be extended to secure the plate firmly to the floor behind the door. As seen the plate is disposed so that its longitudinal axis is normal to the door when the latter is in the closed position.

The stop assembly also includes a stop member 25 which is made of a material which is stiffly resilient, eg. vulcanized rubber. The stop member is wedge-shaped having a flat undersurface 26 and an upper surface 27 which inclines upwards rearwardly from a nose 29 to a butt 31.

Extending downwardly from the undersurface of the stop member adjacent the butt are a pair of longitudinally spaced cylindrical pins, severally 33 which can be legs of an imbedded U-bolt 33.1. The pins and stop member can be substantially integral construction, the U-bolt being inserted when the stop member is molded so that it is firmly imbedded in the stop member. The pins are spaced apart the same distance as the openings of each pair of openings 17 and 18 of the plate so that the stop member can be positioned, selectively, with the pins in either the front pair 17 or the rear pair 18 of the openings.

In installing the door stop assembly, the stop plate is secured in position on the floor a distance from the door so that with the pins located in the forward openings 17, as shown in solid outline, the stop member has a jam fit beneath the door with the door in the closed position. With the pins located in the rear openings 18, the stop member being shown in broken outline 34, the door can be opened slightly from its closed position before coming into jamming engagement with the stop member. It is seen that the resiliency of the stop member enables the latter to be deflected slightly to permit the butt end to be lifted sufficiently when the nose is placed under the door to enable the pins to be inserted in the forward openings 17. In order to fit the stop member in place in a jamming position it is only necessary to slide the nose under the door then lift the butt and slip the pins into the openings 17 of the plate. This is not necessary when the pins are to be inserted in the rear openings 18.

It is evident that with the pins of the stop member secured in either the front or rear openings 17 or 18 the stop member cannot be rotated nor can it be moved laterally from outside the door. Thus the door is held secure in either the jam closed position or the stop position and thus greatly hinder, if not make impossible, forced entry.

When the stop member is not in use it is seen that the only thing projecting above the surface of the floor is the floor plate which can be very thin and which can be countersunk if desired.

I claim:

1. A door stop assembly for employment between the lower edge of a door and a floor over which the door swings comprising:

a. a stop member having a nose portion insertable beneath the door and a butt portion for engaging the door, said stop member having a flat floor engaging undersurface, b. a "U" bolt embedded in the stop member having legs projecting from the undersurface thereof, c. a floor plate adapted to be secured to the floor adjacent the door and having at least one pair of openings for slidably receiving the legs of the "U" bolt so as to prevent lateral and rotative movement of the stop member relative to the door, d. the stop member being formed of a resilient material so as to enable said member to be flexed upwards away from the floor when in jamming position beneath a closed door so as to enable the legs to be inserted in the openings of the floor plate.

2. A door stop assembly as claimed in claim 1 in which the stop member is wedge-shaped and adapted to have a jam fit beneath the door.

3. A stop member as claimed in claim 1 in which the floor plate has two pairs of longitudinally aligned and spaced apart openings so as to enable the stop member to be positioned in jamming position against the door to maintain the door closed and in a position spaced from the door to enable the door to be opened slightly.

* * * * *